US010745225B2

(12) United States Patent
Ohashi et al.

(10) Patent No.: US 10,745,225 B2
(45) Date of Patent: Aug. 18, 2020

(54) PRINTING APPARATUS AND CONTROL METHOD

(71) Applicant: CANON KABUSHIKI KAISHA, Tokyo (JP)

(72) Inventors: Takakazu Ohashi, Kawasaki (JP); Kouhei Tokuda, Fuchu (JP)

(73) Assignee: Canon Kabushiki Kaisha, Tokyo (JP)

( * ) Notice: Subject to any disclaimer, the term of this patent is extended or adjusted under 35 U.S.C. 154(b) by 37 days.

(21) Appl. No.: 16/242,358

(22) Filed: Jan. 8, 2019

(65) Prior Publication Data

US 2019/0232689 A1 Aug. 1, 2019

(30) Foreign Application Priority Data

Jan. 31, 2018 (JP) ..... 2018-014625

(51) Int. Cl.

| | |
|---|---|
| ***B65H 5/06*** | (2006.01) |
| ***B41J 11/06*** | (2006.01) |
| ***B41J 13/03*** | (2006.01) |
| ***B65H 29/12*** | (2006.01) |
| ***B41J 11/00*** | (2006.01) |
| ***B41J 13/00*** | (2006.01) |

(52) U.S. Cl.

CPC ..... *B65H 5/062* (2013.01); *B41J 11/0065* (2013.01); *B41J 11/0085* (2013.01); *B41J 11/06* (2013.01); *B41J 13/0027* (2013.01); *B41J 13/03* (2013.01); *B65H 29/125* (2013.01)

(58) Field of Classification Search

CPC ..... B65H 2701/1313; B65H 29/125; B41J 11/0065; B41J 11/0085

See application file for complete search history.

(56) References Cited

U.S. PATENT DOCUMENTS

| | | | |
|---|---|---|---|
| 7,093,931 | B2 | 8/2006 | Ishii et al. |
| 7,367,668 | B2 | 5/2008 | Ishii et al. |

(Continued)

FOREIGN PATENT DOCUMENTS

| | | | |
|---|---|---|---|
| EP | 1 304 225 | A2 | 4/2003 |
| EP | 2 708 367 | A2 | 3/2014 |

(Continued)

OTHER PUBLICATIONS

U.S. Appl. No. 16/257,663, Naoki Zaizen Takakazu Ohashi, filed Jan. 25, 2019.

(Continued)

*Primary Examiner* — Howard J Sanders

(74) *Attorney, Agent, or Firm* — Venable LLP

(57) ABSTRACT

A printing apparatus has a conveyance roller and a driven roller disposed upstream of a print head in the first direction, a platen facing the print head and supporting the print medium, a producing unit producing a holding force for holding the print medium at the platen. A conveyance operation includes a first conveyance operation in which the print medium is conveyed without any release from between the conveyance roller and the driven roller and a second conveyance operation in which the print medium is released from between the conveyance roller and the driven roller. A rotation amount of the conveyance roller during the second conveyance operation is increased than that during the first conveyance operation.

17 Claims, 12 Drawing Sheets

(56) References Cited

U.S. PATENT DOCUMENTS

| | | | | |
|---|---|---|---|---|
| 7,413,361 | B2 | 8/2008 | Kawaguchi | |
| 7,422,320 | B2 | 9/2008 | Sugiura | |
| 7,543,927 | B2 * | 6/2009 | Campillo | B41J 11/0065 347/101 |
| 7,641,329 | B2 | 1/2010 | Akiyama et al. | |
| 8,286,960 | B2 | 10/2012 | Teshigawara et al. | |
| 8,342,635 | B2 | 1/2013 | Sasaki et al. | |
| 8,678,370 | B2 | 3/2014 | Teshigawara et al. | |
| 8,840,209 | B2 * | 9/2014 | Izoe | B41J 29/38 347/14 |
| 8,979,235 | B2 | 3/2015 | Ishida et al. | |
| 9,440,463 | B2 | 9/2016 | Kudo | |
| 10,611,177 | B2 * | 4/2020 | Zaizen | B41J 11/0065 |
| 2004/0189767 | A1 * | 9/2004 | Kodama | B41J 2/185 347/101 |
| 2004/0252176 | A1 | 12/2004 | Sugiura | |
| 2006/0023051 | A1 | 2/2006 | Akiyama et al. | |
| 2006/0098073 | A1 | 5/2006 | Kawaguchi | |
| 2007/0165092 | A1 * | 7/2007 | Kito | B41J 11/0065 347/102 |
| 2010/0044947 | A1 | 2/2010 | Teshigawara et al. | |

FOREIGN PATENT DOCUMENTS

| | | | |
|---|---|---|---|
| JP | 2004-175082 | A | 6/2004 |
| JP | 4850557 | B2 | 1/2012 |
| JP | 2015-196324 | A | 11/2015 |
| WO | 2017/111906 | A1 | 6/2017 |

OTHER PUBLICATIONS

Extended European Search Report dated Jun. 26, 2019, issued in European Application No. 19152555.9.

* cited by examiner

PRINTING APPARATUS AND CONTROL METHOD

BACKGROUND OF THE INVENTION

Field of the Invention

The present invention relates to a printing apparatus and a control method therefor.

Description of the Related Art

Japanese Patent Laid-Open No. 2015-196324 discloses an ink jet printing apparatus of a serial type, in which a conveyance roller pair is disposed upstream of a print head in a conveyance direction of a print medium, and a print operation by the print head and a conveyance operation by the conveyance roller pair are alternately repeated so as to print an image. Japanese Patent No. 4850557 discloses an ink jet printing apparatus of a serial type, in which a conveyance roller pair is disposed upstream of a print head whereas a discharge roller pair is disposed downstream thereof, and a print operation by the print head and a conveyance operation by the conveyance roller pair and the discharge roller pair are alternately repeated so as to print an image.

In the case of the configuration disclosed in Japanese Patent Laid-Open No. 2015-196324, it is difficult to register the print medium with respect to the print head after the rear end of the print medium leaves the conveyance roller pair. In view of this, after the rear end of the print medium leaves the conveyance roller pair, no print operations are performed, and therefore, a relatively large blank space is formed at the rear end of an image.

In the case of the configuration disclosed in Japanese Patent No. 4850557, even after the rear end of the print medium leaves the conveyance roller pair, the discharge roller pair nips the print medium, thereby achieving the registration of the print medium with respect to the print head. In other words, even after the rear end of the print medium leaves the conveyance roller pair, the print operation can be performed, thus enabling an image to be printed up to the vicinity of the rear end of the print medium, that is, with a relatively small blank.

However, since a driven roller or a pulley of the discharge roller pair is brought into direct contact with a side on which an image is printed, an image that has been just printed may be degraded according to the type of print medium or the image.

SUMMARY OF THE INVENTION

The present invention has been accomplished to solve the above-described problems. Thus, its object is to provide a printing apparatus and a conveyance control method therefor, in which print operations can be performed without degrading an image even after the rear end of a print medium leaves a conveyance roller pair disposed upstream of a print head.

According to a first aspect of the present invention, there is provided a printing apparatus comprising: a carriage configured to move a print head having nozzles arranged in a first direction, in a second direction crossing the first direction; a conveying unit disposed upstream of the print head in the first direction and configured to convey a print medium in the first direction according to a rotation of a conveyance roller and a driven roller which hold the print medium therebetween; a platen located at a position facing the print head and configured to support the print medium; a producing unit configured to produce a holding force for holding the print medium at the platen; and a control unit configured to control the conveying unit in order to convey the print medium, wherein the printing apparatus performs a print operation in which the print head prints an image during the carriage is moved and a conveyance operation in which the conveying unit conveys the print medium by a predetermined distance, so as to print an image on the print medium, the conveyance operation including: a first conveyance operation in which the print medium held between the conveyance roller and the driven roller is conveyed without any release from between the conveyance roller and the driven roller on the way of the rotation of the conveyance roller; and a second conveyance operation in which the print medium held between the conveyance roller and the driven roller is released from between the conveyance roller and the driven roller on the way of the rotation of the conveyance roller, and then, is conveyed, wherein, after the second conveyance operation, the print medium is held on the platen by the holding force and thus, an image is printed of a predetermined length in the first direction, and wherein the control unit controls the conveying unit in such a manner as to increase the rotation amount of the conveyance roller during the second conveyance operation than the rotation amount of the conveyance roller during the first conveyance operation in a case where an image is printed by the predetermined length in the first direction after the first conveyance operation.

According to a second aspect of the present invention, there is provided a A printing apparatus comprising: a print head having nozzles arranged therein; a conveying unit disposed upstream of the print head in a first direction and configured to convey a print medium in the first direction according to a rotation of a conveyance roller and a driven roller which hold the print medium therebetween; a platen located at a position facing the print head and configured to support the print medium; a producing unit configured to produce a holding force, for holding the print medium, at the platen; and a control unit configured to control the conveying unit in order to convey the print medium, wherein the printing apparatus performs a print operation in which the print head prints an image and a conveyance operation in which the conveying unit conveys the print medium by a predetermined distance, so as to print an image on the print medium, the conveyance operation including: a first conveyance operation in which the print medium held between the conveyance roller and the driven roller is conveyed without any release from between the conveyance roller and the driven roller on the way of the rotation of the conveyance roller; and a second conveyance operation in which the print medium held between the conveyance roller and the driven roller is released from between the conveyance roller and the driven roller on the way of the rotation of the conveyance roller, and then, is conveyed, wherein, after the second conveyance operation, the print medium is held on the platen by the holding force and thus, an image is printed of a predetermined length in the first direction, and wherein the control unit controls the conveying unit in such a manner as to increase the rotation amount of the conveyance roller during the second conveyance operation than the rotation amount of the conveyance roller during the first conveyance operation in a case where an image is printed by the predetermined length in the first direction after the first conveyance operation.

According to a third aspect of the present invention, there is provided a control method of a printing apparatus, the printing apparatus including: a carriage configured to move a print head having nozzles arranged in a first direction, in a second direction crossing a first direction; a conveying unit disposed upstream of the print head in the first direction and configured to convey a print medium in the first direction according to a rotation of a conveyance roller and a driven roller which hold the print medium therebetween; a platen located at a position facing the print head and configured to support the print medium; and a producing unit configured to produce a holding force, for holding the print medium, at the platen, the control method comprising the steps of: performing a print operation in which the print head prints an image during the carriage is moved and a conveyance operation in which the conveying unit conveys the print medium by a predetermined distance, so as to print an image on the print medium; and controlling the conveying unit in a case where the print medium is conveyed, wherein the conveyance operation includes: a first conveyance operation in which the print medium held between the conveyance roller and the driven roller is conveyed without any release from between the conveyance roller and the driven roller on the way of the rotation of the conveyance roller; and a second conveyance operation in which the print medium held between the conveyance roller and the driven roller is released from between the conveyance roller and the driven roller on the way of the rotation of the conveyance roller, and then, is conveyed, wherein, after the second conveyance operation, the print medium is held on the platen by the holding force and thus, an image is printed of a predetermined length in the first direction, and wherein in the controlling step, the conveying unit is controlled in such a manner as to increase the rotation amount of the conveyance roller during the second conveyance operation than the rotation amount of the conveyance roller during the first conveyance operation in a case where an image is printed by the predetermined length in the first direction after the first conveyance operation.

Further features of the present invention will become apparent from the following description of exemplary embodiments with reference to the attached drawings.

DESCRIPTION OF THE EMBODIMENTS

Figure 1:
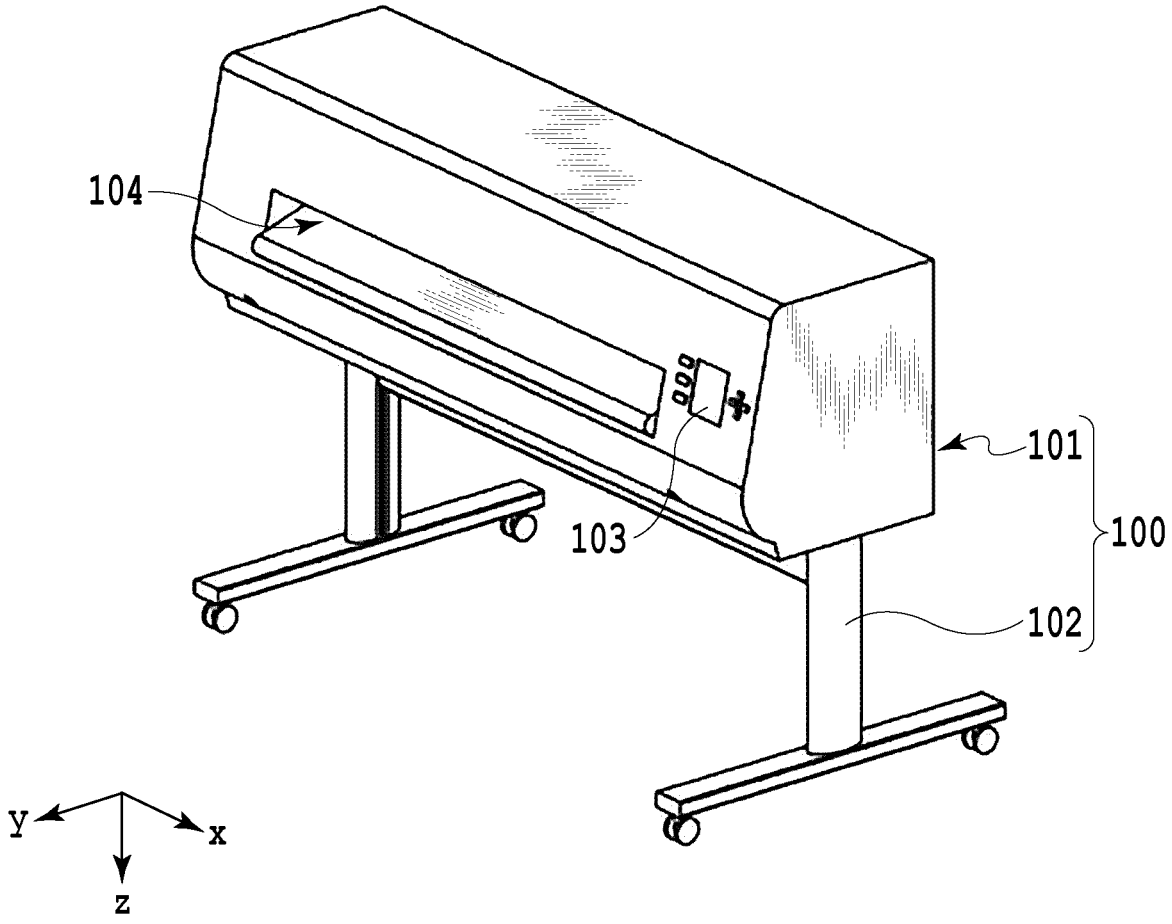
FIG. 1 is a view showing the external appearance of a printing apparatus.

FIG. 1 is the external appearance of a printing apparatus (hereinafter simply referred to as a printing apparatus 100 of an ink jet system to be used in the present embodiment. The printing apparatus 100 includes a main unit 101 and a leg unit 102 which supports the main unit 101. At the outer surface of the main unit 101 is disposed a operation panel 103 for use in inputting various settings or commands or confirming information on the printing apparatus 100 by a user. The printing apparatus 100 in the present embodiment can print an image on both continuous paper (continuous sheets) such as roll paper and cut paper (cut sheets) such as standard-sized paper. The print medium having an image printed thereon is discharged from a discharge port 104 disposed at a front surface.

Figure 2A:
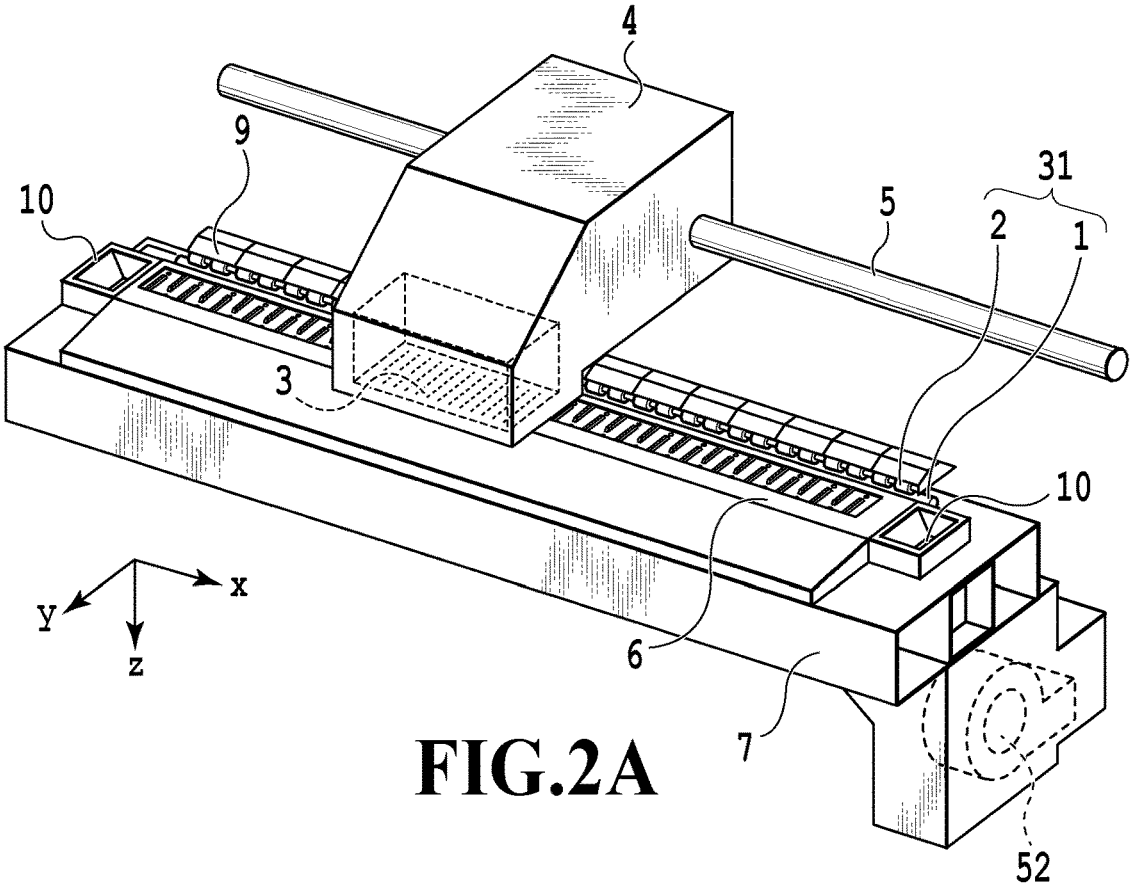
FIGS. 2A and 2B are a perspective view and a cross-sectional view showing a print unit, respectively.
Figure 2B:
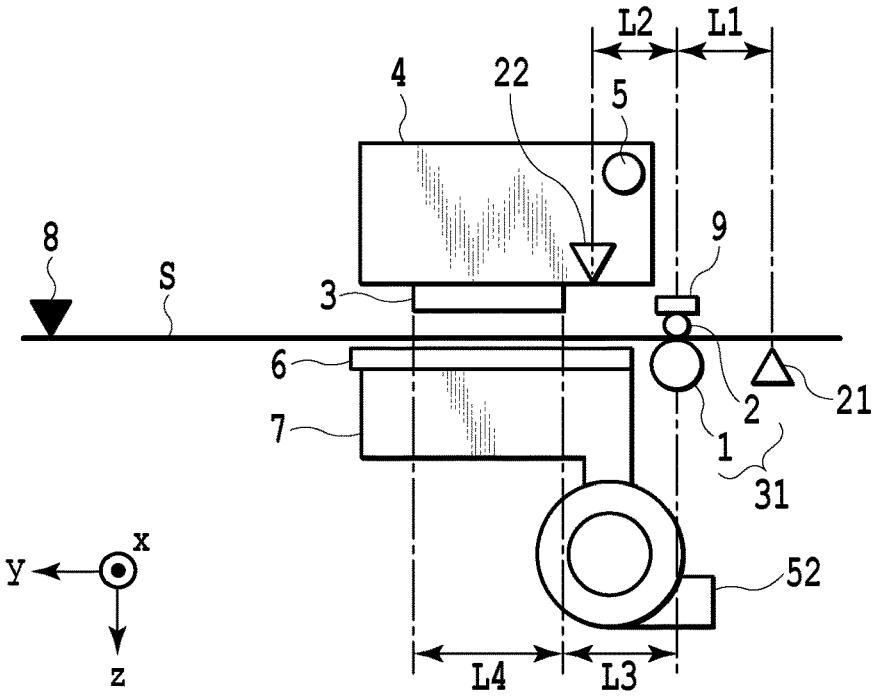

FIGS. 2A and 2B are a perspective view and a cross-sectional view showing a print unit, respectively. As shown in FIG. 2A, a carriage 4 having a print head 3 mounted thereon can be moved in ±x directions (i.e., a main scanning direction) along a carriage shaft 5 extending in the x direction. The print head 3 has a plurality of ejection ports (i.e., nozzles), through which the same type of ink is ejected, arranged in a y direction. While the carriage 4 is moved, ink is ejected through the plurality of ejection ports in a +z direction (i.e., the direction of gravity) in accordance with image data. The ejection operation of the print head 3 and the movement of the carriage 4 achieve one print operation, and thus, a band image of one band is printed on a print medium S placed under the print head 3. Here, the print head 3 has a plurality of arrays, each consisting of the above-described ejection ports, in the x direction in a manner corresponding to ink colors of cyan, magenta, yellow, and black.

Even if the print medium S is roll paper or cut paper, the print medium S is conveyed in the y direction crossing the x direction according to the rotation of a pair of a conveyance roller 1 and a pinch roller 2 extending in the x direction while being held therebetween. In the present embodiment, the conveyance roller 1 is a drive roller connected to a conveyance motor 51 (see FIG. 4). The pinch roller 2 is a driven roller which follows the rotation of the conveyance roller 1. The plurality of pinch rollers 2 are arranged in the x direction, and are fixed to a pinch roller holder 9.

The pinch roller holder 9 can ascend or descend in the z direction by a separation mechanism 13 (not shown in FIGS. 2A and 2B). The pinch roller 2 and the conveyance roller 1 switchably nip or do not nip a print medium according to the ascent or descent of the pinch roller holder 9. Thereafter, a roller pair including the conveyance roller 1 and the pinch roller 2 will be referred to as a conveyance roller pair 31.

As shown in FIG. 2B, a first sensor 21 is positioned upstream of the conveyance roller pair 31 in the conveyance direction (i.e., the y direction). The first sensor 21 is provided with a light emitting element and a light receiving element. A reflection light beam emitted from the light emitting element is received by the light receiving element, thus detecting the existence of the print medium S.

In the meantime, the carriage 4 includes a second sensor 22 positioned upstream of the print head 3. The second sensor 22 is provided with a light emitting element and a light receiving element made of various LEDs. A reflection light beam emitted from the light emitting element is received by the light receiving element, thus detecting the existence, thickness, or the like of the print medium S. For example, even if the print medium S is a transparent film, the second sensor 22 can detect its existence. Moreover, the second sensor 22 performs detection operations during the movement of the carriage 4 so as to detect the position of an end of the print medium in the x direction, the width of the print medium S, and the like as well. Here, although the second sensor 22 is positioned upstream of the print head 3, it may be disposed downstream of the print head 3.

In FIG. 2B, a distance from the first sensor 21 to a nipped portion (i.e., a held portion) of the conveyance roller pair 31 in the y direction is designated by L1 whereas a distance from the nipped portion of the conveyance roller pair 31 to the second sensor 22 is designated by L2. Moreover, a distance from the nipped portion of the conveyance roller pair 31 to the ejection port located most upstream of the print head 3 (i.e., in a −y direction) is designated by L3, and furthermore, a distance (i.e., a print width) from the ejection port located most upstream (i.e., in the −y direction) to the ejection port located most downstream (i.e., in a +y direction) is designated by L4. A cutter 8 is provided farther downstream (i.e., in the +y direction) of the carriage 4, for cutting the rear end of an image in a case where the print medium S is roll paper.

A platen 6 for supporting the print medium S at a back surface thereof (i.e., a second surface) at an area, at which a print operation is performed, is disposed at a position facing an ejection port surface of the print head 3 in the z direction. As shown in FIG. 2A, a preliminary ejection opening 10 for receiving ink droplets which are discharged during a preliminary ejection operation by the print head 3 is disposed at a movement area of the print head 3 and outside of the platen 6 in the ±x direction. When the print head 3 is moved in the main scanning direction, ink is preliminarily ejected toward the preliminary ejection opening 10, thus suppressing drying or an increase in viscosity of the ink at the print head 3 so as to stabilize the ejection of the ink. Here, to the platen 6 and the preliminary ejection port 10 is connected a suction fan 52.

Figure 3A:
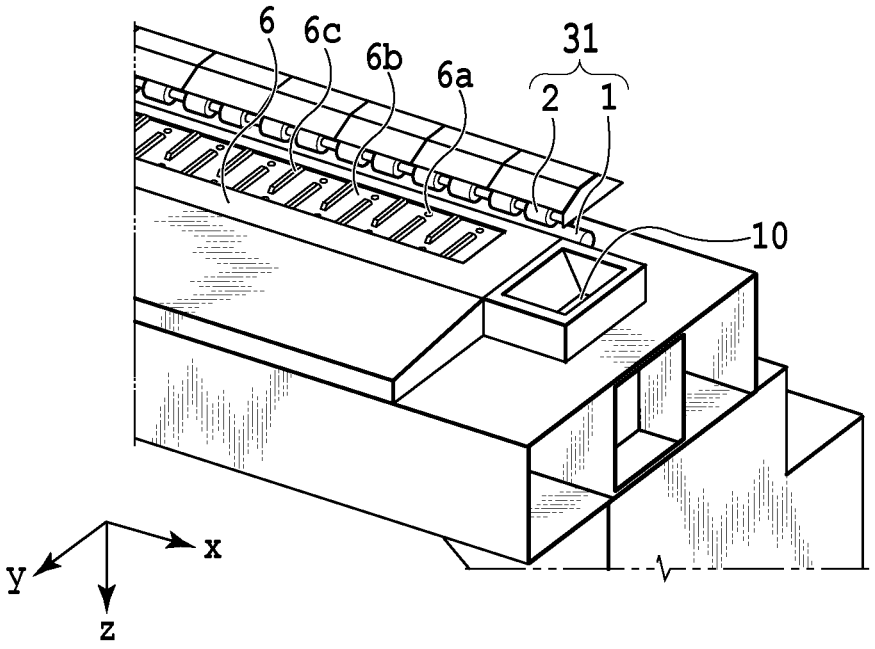
FIGS. 3A and 3B are a perspective view and a cross-sectional view showing the detailed configuration of a platen, respectively.
Figure 3B:
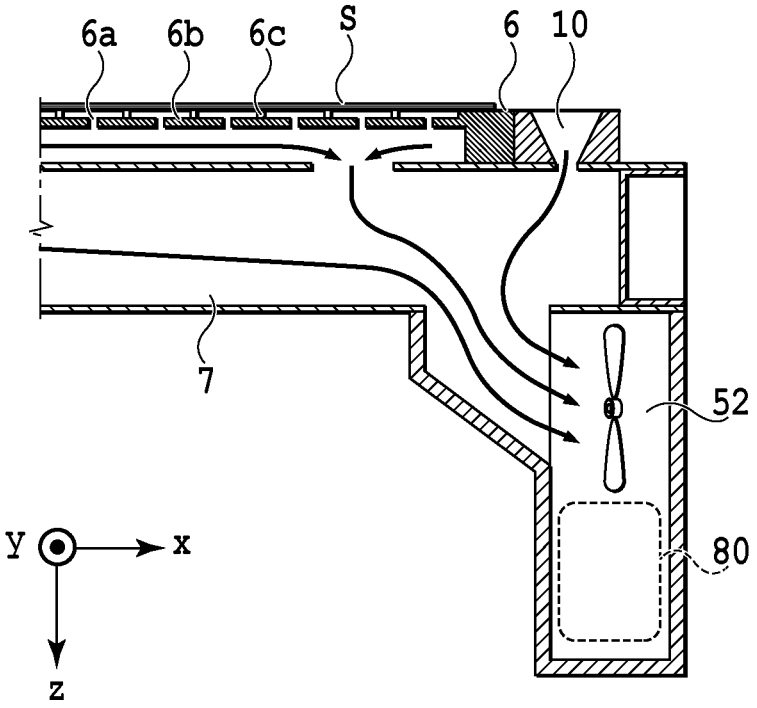

FIGS. 3A and 3B are a perspective view and a cross-sectional view showing the detailed configurations of the platen 6 and preliminary ejection opening 10, respectively. As shown in FIG. 3A, the platen 6 includes, in the x direction, a plurality of suction ports 6*a*, which suck the print medium S being printing at back surfaces thereof, a plurality of suction grooves 6*b*, and a plurality of ribs 6*c* that support the print medium S in contact with the second surface of the print medium S. The suction ports 6*a* and the preliminary ejection opening 10 are connected to the suction fan 52 via a buffer chamber 7, as shown in FIG. 3B.

With this configuration, when the suction fan 52 is actuated, the buffer chamber 7 comes to have a negative pressure, thus producing a suction force at the suction ports 6*a* and the preliminary ejection opening 10. With this suction force, the print medium S placed on the platen 6 is pressed against the platen 6, thereby maintaining its smoothness. The preliminary ejection opening 10 can collect the ink droplets, which are preliminarily ejected, without any diffusion inside the apparatus, and then, the ink droplets can be guided up to the suction fan 52. Incidentally, a filter 80 for absorbing the collected ink is housed inside of the suction fan 52. The ink sucked through the preliminary ejection opening 10 is held at the filter 80, and then, air sucked together with the ink is discharged outside of the printing apparatus 100 by the suction fan 52.

Figure 4:
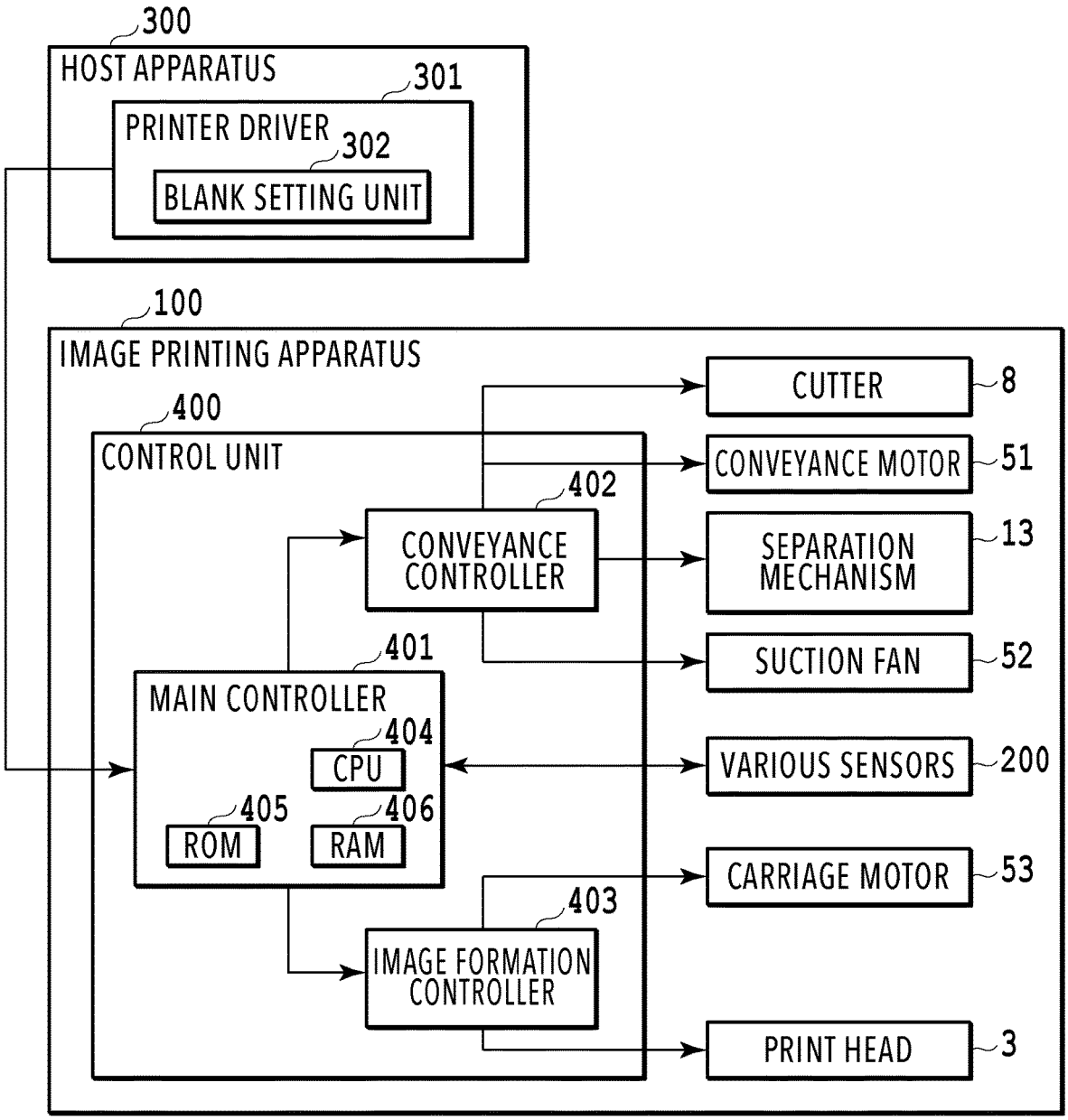
FIG. 4 is a block diagram illustrating a control configuration in the printing apparatus.

FIG. 4 is a block diagram illustrating a control configuration of the printing apparatus 100. The diagram illustrates a configuration in which an image formed in a host apparatus 300 connected outside is printed in the printing apparatus 100. In the host apparatus 300 a printer driver 301 is installed. A user sets types of print medium S or print modes through the printer driver 301, which then issues a print command of the image produced in the host apparatus 300. Here, a blank setting unit 302 in the printer driver 301 is adapted to determine and set the blank amount of the print medium S based on an input by the user or the size of the image.

The printer driver 301 performs predetermined image processing in accordance with set parameters, and then, produces image data that can be printed by the printing apparatus 100. Thereafter, the printer driver 301 adds blank information set by the blank setting unit 302, print mode information, and the like to the image data, and thus, produces print data, which is then transferred to the printing apparatus 100.

In the printing apparatus 100, the control unit 400 mainly includes a main controller 401, a conveyance controller 402, and an image formation controller 403. Moreover, the main controller 401 is provided with a CPU 404 serving as a calculator, a ROM 405, and a RAM 406. In the main controller 401, the CPU 404 controls the entire apparatus in accordance with various programs or parameters stored in the ROM 405 by the use of the RAM 406 serving as a work area. The ROM 405 stores therein programs, parameters, and the like for use in performing processing illustrated in a flowchart, described later. The CPU 404 reads these programs and performs the processing illustrated in the flowchart by the use of the RAM 406.

The conveyance controller 402 controls the driving of the conveyance motor 51 so as to rotate the conveyance roller 1, the suction fan 52, the cutter 8, the separation mechanism 13, and the like under the instruction by the main controller 401. The image formation controller 403 controls the driving of a carriage motor 53 for moving the carriage 4 and the print head 3 under the instruction by the main controller 401. Various sensors 200 include a temperature sensor for measuring the temperature of the print head 3, an encoder sensor for detecting the position of the carriage 4 in the x direction, and the like in addition to the above-described first sensor 21 and second sensor 22. The main controller 401 controls the entire apparatus based on the results detected by the sensors.

FIGS. 5A to 5D are diagrams illustrating states of registration before the print medium S is printed (i.e., initial registration) in a case where the print medium S is cut paper. When the print medium S is first fed, the CPU 404 lets the separation mechanism 13 separate the conveyance roller pair 31 via the conveyance controller 402. A fore end F of the print medium S is inserted between the conveyance roller 1 and the driven roller 2, then the separation mechanism 13 allows again the conveyance roller pair 31 to nip the print medium S via the conveyance controller 402, and then, the suction fan 52 starts to be actuated.

Figure 5A:
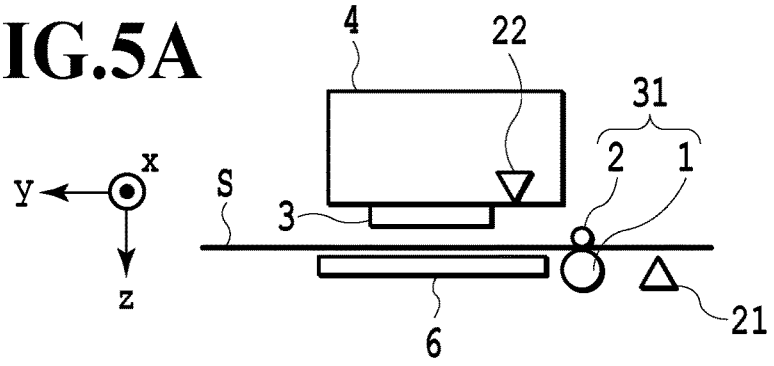
FIGS. 5A to 5D are diagrams illustrating the initial registration of a print medium.
Figure 5B:
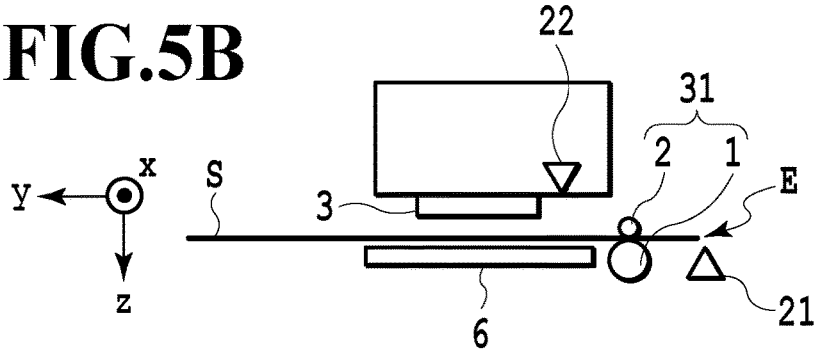

FIG. 5A illustrates a state in which the fore end of the print medium S is nipped by the conveyance roller pair 31, and then, the conveyance motor 51 is rotated forward while confirming values detected by the first sensor 21 so that the print medium S is conveyed in the y direction. As illustrated in FIG. 5B, at a timing when the first sensor 21 detects a rear end E of the print medium S, the CPU 404 stops the conveyance motor 51. In this manner, the rear end E of the print medium S is detected.

Figure 5C:
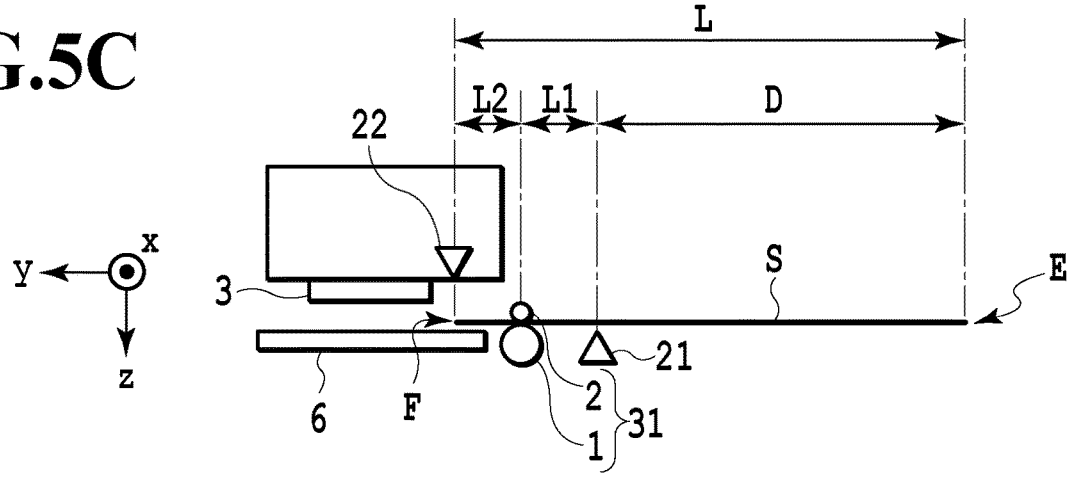
Figure 5D:
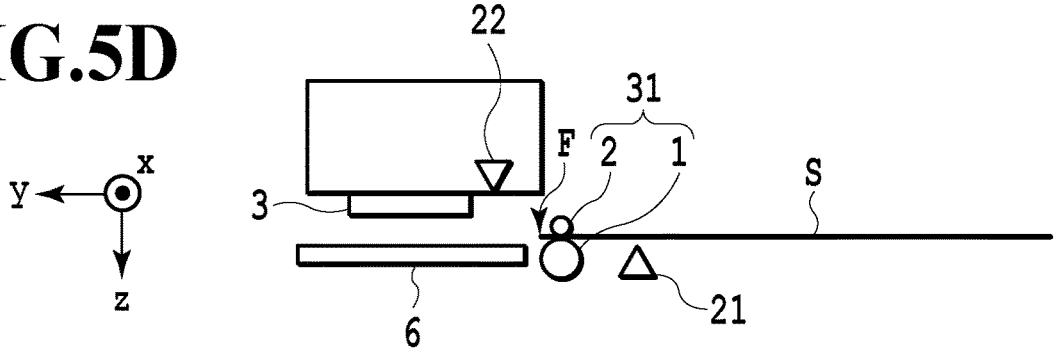

Next, the CPU 404 reversely rotates the conveyance motor 51 so as to reversely convey the print medium S in the −y direction and counts the number of drive pulses applied to the conveyance motor 51 while confirming values detected by the second sensor 22. FIG. 5C illustrates a state in which the print medium S is reversely conveyed by the conveyance roller pair 31 and the second sensor 22 detects the fore end F of the print medium S. At this timing, the CPU 404 stops the conveyance motor 51. In this manner, the fore end F of the print medium S is detected.

Here, fixed values such as the distance L1 from the first sensor 21 to the conveyance roller pair 31, the distance L2 from the conveyance roller pair 31 to the second sensor 22, and a conveyance distance w at the time of the application of one pulse to the conveyance motor 51 are previously stored in the ROM 405. As a consequence, when the second sensor 22 detects the fore end F of the print medium S, the CPU 404 can calculate a length L of the print medium S in the y direction based on the fixed values and the count number C of drive pulses which occur from the state illustrated in FIG. 5B to the state illustrated in FIG. 5C ($L=w\times C+L1+L2$).

Thereafter, the CPU 404 reversely rotates the conveyance motor 51 again while counting the number of drive pulses. The fore end F of the print medium S stands by in a state illustrated in FIG. 5D, that is, in a state in which it slightly projects from the conveyance roller pair 31 in the +y direction. This is the initial registration of the cut paper.

Figure 6:
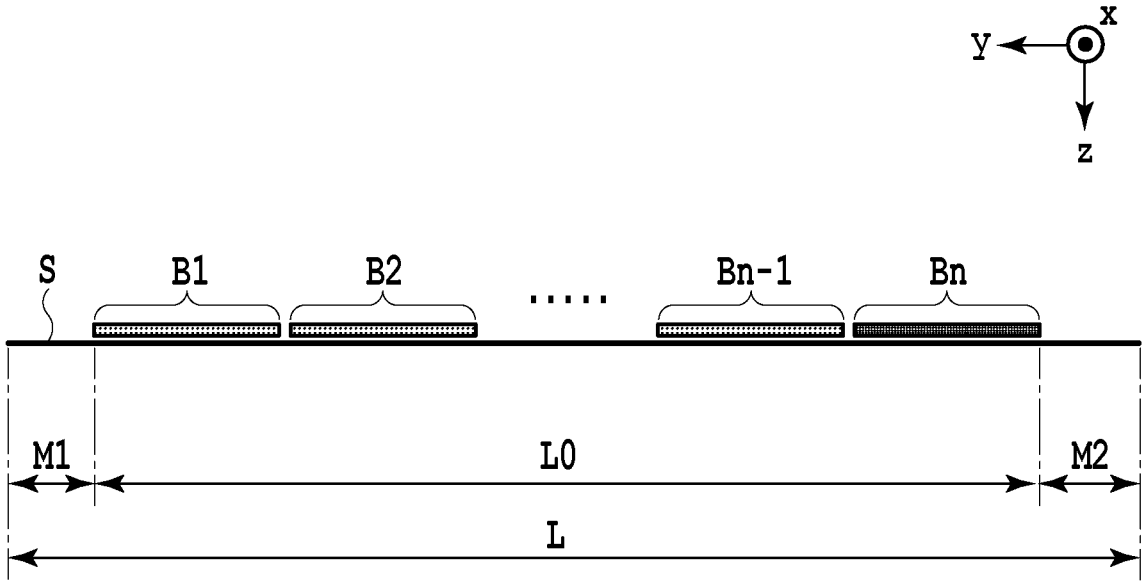
FIG. 6 is a diagram illustrating the corresponding relationship between print operations and image areas (bands)

Subsequently, print operations will be explained below. FIG. 6 illustrates the corresponding relationship between individual print operations and the image areas (i.e., the bands) in a case where a predetermined image is printed on the print medium S having the length L in the y direction, wherein a fore end blank amount is denoted by M1, the length of the image is denoted by L0, and a rear end blank amount is denoted by M2. The CPU 404 divides the image area L0 into n areas (i.e., bands B1 to Bn) in a manner corresponding to the print width L4 of the print head 3. The n areas are printed sequentially in n print operations. At this time, the bands B1 to Bn in total may be smaller than the print width L4.

Figure 7A:
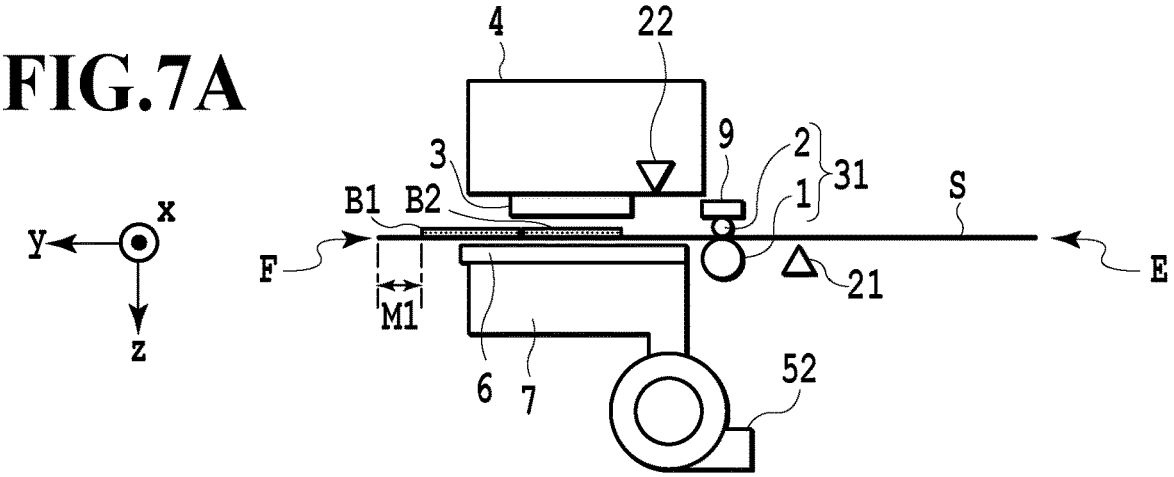
FIGS. 7A to 7C are diagrams illustrating the procedures of the print operation.
Figure 7B:
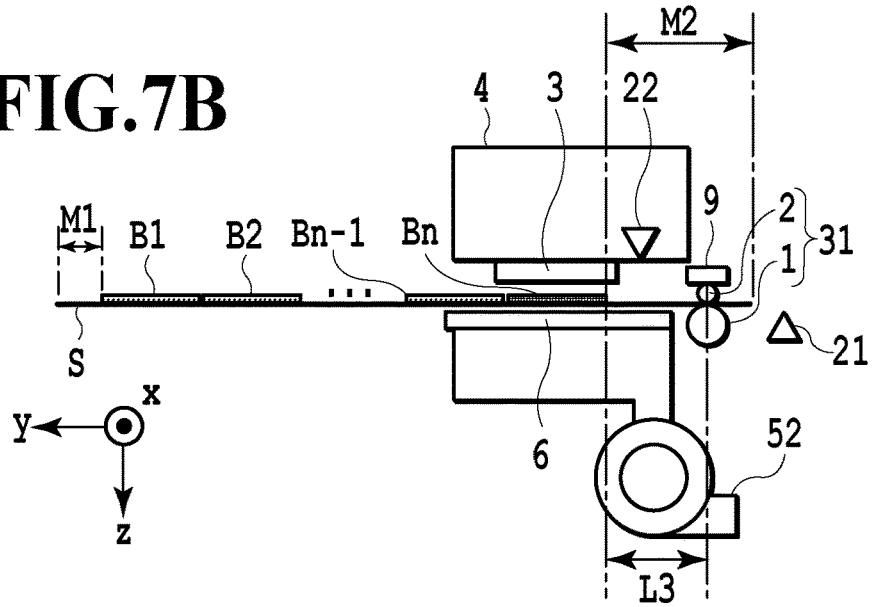
Figure 7C:
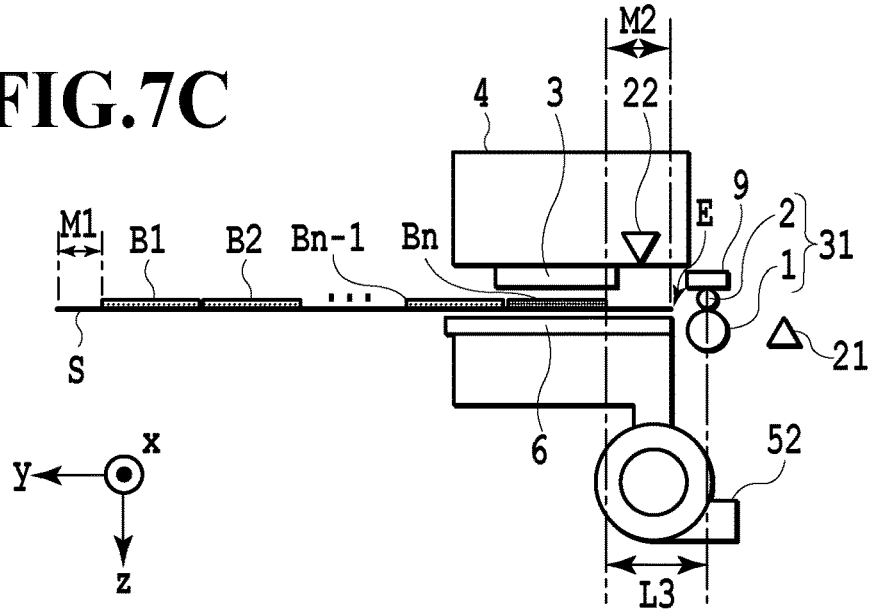

FIGS. 7A to 7C are diagrams illustrating the procedures of the print operation. Upon completion of the above-described initial registration, the CPU 404 performs a print operation for the band B1 by the use of the print head 3 in a state in which the fore end blank amount M1 is provided at the fore end of the print medium S. In this manner, an image B1 of a first band is printed on the print medium S by the print head 3. Next, the CPU 404 drives the conveyance motor 51 to convey the print medium S by a band B2, so that an image B2 of a second band is printed on the print medium S by the print head 3. FIG. 7A illustrates a state in which the print head 3 performs a print operation of the second band.

The above-described print operation by the print head 3 and the above-described conveyance operation by the conveyance roller pair 31 are alternately repeated up to an (n−1)th print operation. The (n−1) print operations are performed while the print medium S is supported by the suction force of the platen 6 and the nipping force of the conveyance roller pair 31.

FIGS. 7B and 7C illustrate a state in which the print head 3 performs an n-th (last) print operation. FIG. 7B illustrates a case where the rear end blank amount M2 is greater than the distance L3 from the conveyance roller pair 31 to the ejection port located most upstream of the print head 3 (in the −y direction); and FIG. 7C illustrates a case where the rear end blank amount M2 is smaller than the distance L3.

In a case where the rear end blank amount M2 is greater than the distance L3 (M2>L3), the n-th print operation is performed while the conveyance roller pair 31 nips the print medium S, as shown in FIG. 7B. Specifically, in this case, all of the n print operations for printing the image are performed while the print medium S is supported by the conveyance roller pair 31. Upon the completion of the last print operation, the CPU 404 stops the suction fan 52 while rotating the conveyance roller pair 31, so that the print medium S located outside of the conveyance roller pair 31 is discharged through the discharge port 104 by its own weight.

In contrast, in a case where the rear end blank amount M2 is smaller than the length L3 (M2<L3), the n-th print operation is performed in a state in which the conveyance roller pair 31 does not nip the print medium S, as shown in FIG. 7C. In this case, the conveyance roller pair 31 releases the rear end of the print medium S on the way of the rotation thereof during the conveyance operation after the (n−1)th print operation.

For the sake of easy explanation, a conveyance operation during which the print medium S is kept nipped by the conveyance roller pair 31 is referred to as "normal conveyance"; and a conveyance operation during which the print medium S is released from the state nipped by the conveyance roller pair 31 is referred to as "release conveyance." At the time of the "release conveyance" in which the print medium S is released from the nipped state during the conveyance operation, it is more difficult to control the conveyance amount of the print medium S, and furthermore, the conveyance amount is more variable and smaller, in comparison with the "normal conveyance" in which the print medium S is kept nipped. However, although it is difficult to control the proper position of the rear end E of the print medium S, the rear end E of the print medium S can be moved up to a release conveying limit position EL of a predetermined position by adjusting an additional rotation amount $\theta(\theta3-\theta2)$ of the conveyance roller 1 or the suction force of the platen 6 also during the "release conveyance."

Figure 8:
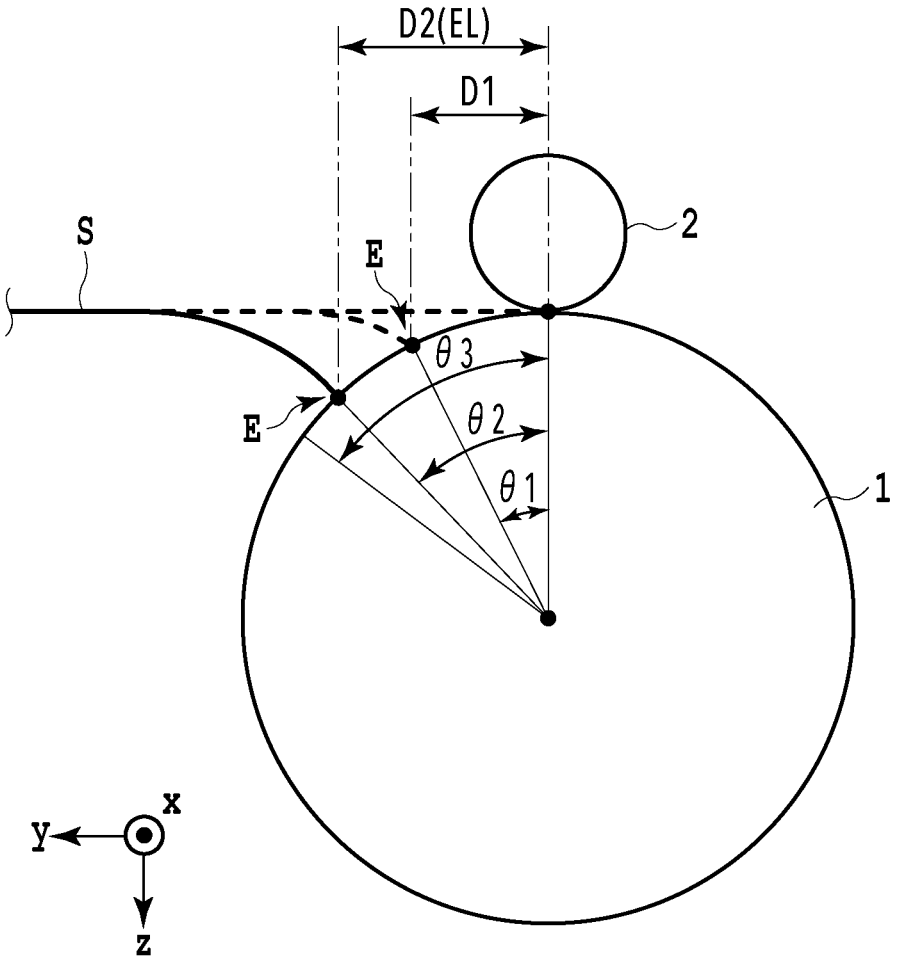
FIG. 8 is a diagram illustrating the details of a state in which a print medium leaves a conveyance roller pair.

FIG. 8 illustrates the print medium S immediately after the print medium S is released from the state nipped by the conveyance roller pair 31 during the "release conveyance." When the rear end E of the print medium S is released from a portion nipped by the conveyance roller pair 31, the rear end E is placed on the outer periphery of the conveyance roller 1. Therefore, as the conveyance roller 1 is rotated, the print medium S is moved in the y direction while it somewhat slides on the outer peripheral surface of the conveyance roller 1 due to the friction force occurring between the rear end E and the outer periphery of the conveyance roller 1.

For example, if the conveyance roller 1 is further rotated by an angle θ2 after the rear end E is released from the nipped portion, the print medium S is pushed forward in the y direction to a position D1, at which the rear end E is located at an angle θ1, only by the conveyance roller 1. Alternatively, if the conveyance roller 1 is rotated by an angle θ3, the rear end E of the print medium S is pushed forward in the y direction to a position D2, at which the rear end E is located at the angle θ2. Here, even if the conveyance roller 1 is further rotated, the rear end E of the print medium S cannot be moved from the position D2 at the angle θ2. This is because no friction force occurring between the rear end E and the outer periphery of the conveyance roller 1 acts when the rear end E is located at the position D2. Thus, this position D2 signifies the release conveying limit position EL.

The print medium S also has an inertial force in the y direction when the rear end E of the print medium S is released from the nipped portion. This inertial force acts on the print medium S to move it in the y direction. The print medium S is attracted in the z direction by the suction force of the suction fan 52 and its own weight, and therefore, the print medium S undergoes the friction force in the −y direction on the platen 6. As a consequence, a distance by which the rear end E of the print medium S is moved in the +y direction after the rear end E of the print medium S is released from the nipped portion depends on the inertial force, the rotation amount θ of the conveyance roller 1 after the rear end E of the print medium S is released from the nipped portion, the suction force of the suction fan 52, and the like. In other words, controlling the rotation amount θ of the conveyance roller 1 or the suction force of the suction fan 52 during the "release conveyance" enables the rear end E of the print medium S to be conveyed up to the release conveying limit position EL.

For example, increasing the additional rotation amount θ of the conveyance roller 1 after the rear end E is released from the nipped portion can increase a distance, by which the conveyance roller 1 pushes the print medium, and the conveyance distance of the print medium S. Alternatively, decreasing the suction force of the suction fan 52 less than a regular value can reduce the friction force acting in the −y direction, thus increasing the conveyance distance of the print medium S.

That is to say, during the "normal conveyance" and during the "release conveyance," the rotation amount of the conveyance roller 1 and the suction force of the suction fan 52 are controlled such that at least one thereof is varied, thus adjusting the conveyance amount of the print medium S during both of the conveyances.

Figure 9:
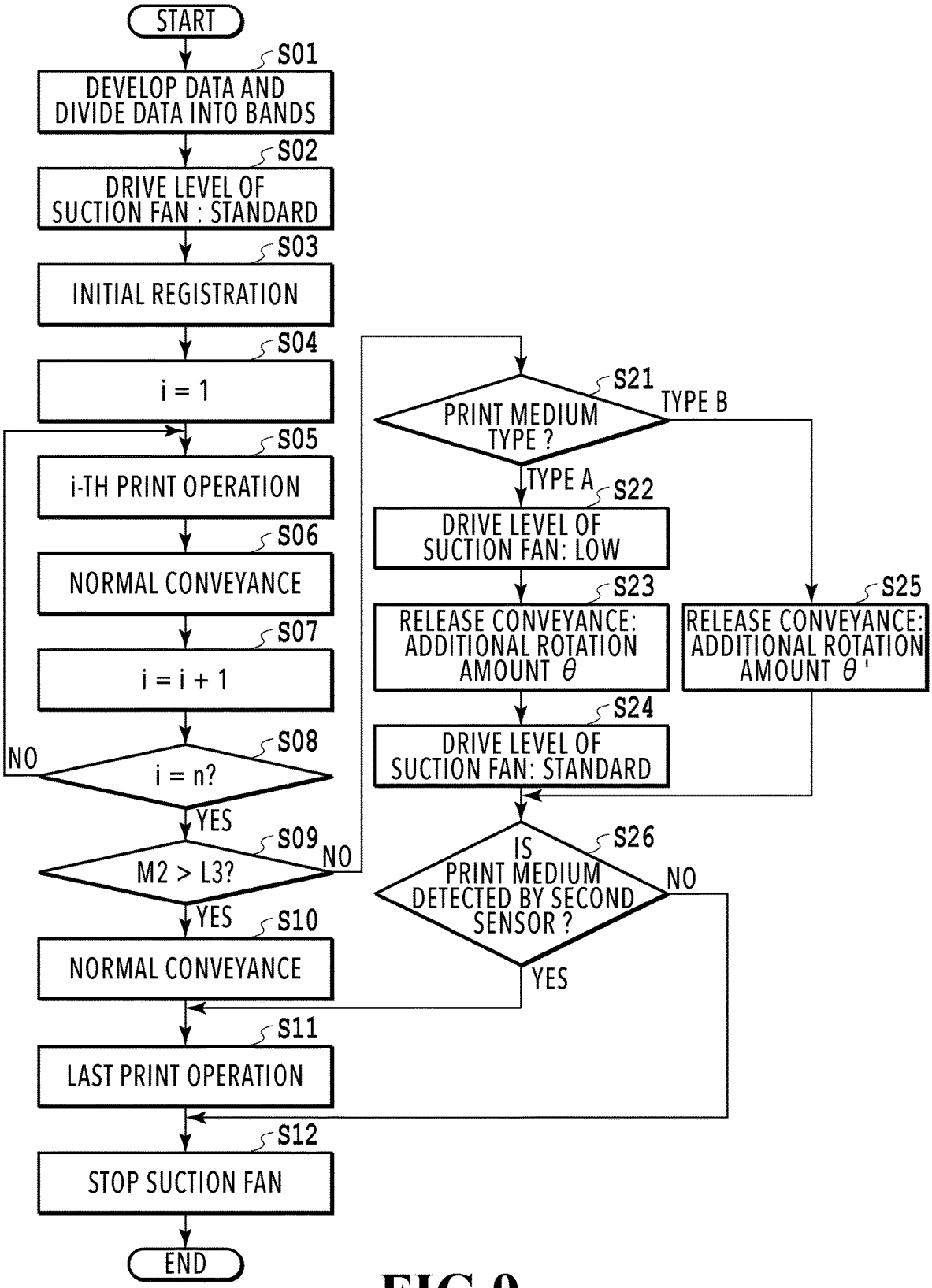
FIG. 9 is a flowchart illustrating a printing process.

FIG. 9 is a flowchart illustrating a printing process to be performed by the CPU 404 in the printing apparatus in a case where the CPU 404 receives a print job for cut paper from the host apparatus 300.

Upon the start of this processing, the CPU 404 first develops the image data included in the received print data in a buffer in the RAM 406. And then, the developed image data is divided into n pieces of band data corresponding to the print operations based on the fore end blank amount M1 and the rear end blank amount M2, which are set in accordance with the print data, and the size L of the print medium S, as explained with reference to FIG. 6 (step S01).

In step S02, the CPU 404 drives the suction fan 52 on a standard level via the conveyance controller 402, thus producing a suction pressure on the platen 6 enough to suck the print medium S onto the platen 6 and smoothly hold the print medium S thereon.

In step S03, the conveyance motor 51 is rotated forward or reversely, and then, the print medium S is registered such that an area, at which an image of a first band next to the fore end blank amount M1 is printed, is positioned right under the print head 3.

In step S04, the CPU 404 initializes a band count value i (i=1). In the subsequent step S05, one print operation is performed. Specifically, the CPU 404 drives the print head 3 in accordance with the image data on a band Bi while driving the carriage motor 53 via the image formation controller 403. Consequently, an image of the band Bi is printed on the print medium S.

In step S06, the CPU 404 drives the conveyance motor 51 via the conveyance controller 402 on a standard level. Driving on the standard level signifies rotating the conveyance roller 1 by a rotation amount equivalent to one band Bi. In this manner, the print medium S is conveyed in the y direction by one band Bi.

In step S07, the CPU 404 increments the band count value i (i=i+1). In the subsequent step S08, the CPU 404 determines whether or not the band count value i is n. If i≠n, it is determined that the next print operation is not yet a print operation of a last line, and therefore, the CPU 404 returns to step S05, in which the next print operation and conveyance operation are performed. In contrast, if i=n in step S08, the next print operation is a print operation of a last line, and thus, the CPU 404 proceeds to step S09.

In step S09, the CPU 404 compares the rear end blank amount M2 set in accordance with the print data with the distance L3 previously stored in the ROM 405 (i.e., the distance from the conveyance roller pair 31 to the ejection port located most upstream of the print head 3). If M2>L3, the CPU 404 proceeds to step S10 and drives the conveyance motor 51 on the standard level via the conveyance controller 402. In this manner, the conveyance roller pair 31 rotates while nipping the print medium S so as to convey it by the last band Bn.

In contrast, if M2<L3 in step S09, the CPU 404 proceeds to step S21 and determines whether or not the type of print medium set in accordance with the print data is classified into a type A or a type B. Here, the type A includes print mediums which are relatively light or thin, and therefore, are sheets which are easily held on the platen 6 only by the suction force of the suction fan 52 even if the suction force of the suction fan 52 is small after the print mediums leave the conveyance roller pair 31. In contrast, the type B includes print mediums which are relatively heavy or thick, and therefore, are sheets which are hardly held on the platen 6 if the suction force of the suction fan 52 is short after the print mediums leave the conveyance roller pair 31. The CPU 404 confirms the type of print medium set in accordance with the print data. If the print medium is of the type A, the CPU 404 proceeds to step S22: in contrast, if the print medium is of the type B, the CPU 404 proceeds to step S25.

In step S22, the CPU 404 switches from the standard drive level of the suction fan 52 to a low drive level via the conveyance controller 402. In this manner, the suction pressure of the platen 6 is reduced to a smaller suction pressure.

In step S23, the CPU 404 performs the "release conveyance" while keeping the additional rotation amount θ. More specifically, the CPU 404 rotates the conveyance roller 1 more by θ than the "normal conveyance" in step S06 in which the print medium is nipped by the conveyance roller pair 31. That is to say, assuming that a rotation amount when the print medium is conveyed by the last band Bn during the "normal conveyance" is θ(Bn), the conveyance roller 1 releases the print medium S while rotating by θ(Bn)+θ. Although the additional rotation amount θ is not particularly restricted, it may be set to an angle corresponding to, for example, about 10 mm on the outer periphery of the conveyance roller 1.

As already described, the movement amount of the print medium released during the "release conveyance" in the +y direction depends on the rotation amount of the conveyance roller 1, the inertial force in the +y direction during the release conveyance, the gravity acting in the z direction, the suction force of the platen 6 acting in the z direction, and so on. That is to say, during the "release conveyance" for the print medium S of the type A, the drive force of the suction fan 52 to be switched in step S22 and the additional rotation amount θ of the conveyance roller 1 set in step S23 are previously set respectively, enough to move the print medium S of the type A by the last band Bn.

Upon the completion of the "release conveyance" in step S23, the CPU 404 proceeds to step S24 and switches the driving level of the suction fan 52 to the standard level via the conveyance controller 402.

In contrast, in step S21, if it is determined that the print medium set in accordance with the print data is of the type B, the CPU 404 proceeds to step S25 and performs the "release conveyance" with an additional rotation amount θ'. More specifically, the conveyance roller 1 releases the print medium S from the state nipped by the conveyance roller pair 31 while rotating more by the additional rotation amount θ' than during the "normal conveyance" in step S06. The additional rotation amount θ' may be an angle corresponding to, for example, about 5 mm on the outer periphery of the conveyance roller 1.

In this manner, the print medium of the type B also is moved by the last band Bn, and thus, is smoothly supported by the platen 6 having a middle suction force. In other words, during the "release conveyance" for the print medium of the type B, the rotation amount θ' of the conveyance roller 1 is previously set such that the print medium S of the type B is moved by the last band Bn in a state in which the drive force of the suction fan 52 is kept on the standard level.

In step S26, the CPU 404 determines whether or not the second sensor 22 detects the print medium S. If the result is affirmative, the print medium S exists right under the print head 3, and therefore, the CPU 404 proceeds to step S11, and performes the last (i.e., the n-th) print operation. In the meantime, if the shortage of the suction force of the suction fan 52 is caused by an erroneous input or the like of information on the print medium S and so on set through the console panel 103, the second sensor 22 may not detect the print medium S in step S26. In this case, the print medium S may not exist right under the print head 3, and therefore, the CPU 404 proceeds to step S12 without performing any last print operation.

In step S12, the CPU 404 stops the suction fan 52 via the conveyance controller 402. In this manner, the print medium S suspending from the front of the platen 6 is released from not only the state nipped by the conveyance roller pair 31 but also the suction force on the platen 6 in the state in which the conveyance roller pair 31 does not nip the print medium S, so that the print medium S is discharged through the discharge port 104 by its own weight. Hence, the present processing comes to an end, and thus, the printing apparatus returns to its standby state.

In the above-described present embodiment, in a case where the last print operation can be performed in the state in which the print medium S is nipped by the conveyance roller pair 31, the "normal conveyance" in which the suction fan 52 is driven on the standard level and the conveyance roller 1 is rotated on the standard level is performed in all of the conveyance operations. In contrast, in a case where the last print operation cannot be performed in the state in which the print medium S is nipped by the conveyance roller pair 31, the "release conveyance" is performed only in the conveyance operation immediately before the last print operation. In other words, conveyance control in which at least one of driving the suction fan 52 and rotating the conveyance roller 1 is different from that during the "normal conveyance" is performed. As a consequence, it is possible to print an image of a good quality even in the vicinity of the rear end of the print medium even if no discharge roller pair disclosed in Japanese Patent No. 4850557 is provided.

Incidentally, although the suction fan 52 is driven on the standard level in step S24 in FIG. 9, it is not essential. The suction force is simply required to be produced enough to hold the print medium S during the print operation of the last line in step S11. The suction force may be higher or lower than the standard level, or it may be adjusted according to the type of print medium S.

Moreover, although the explanation with reference to FIG. 9 is made on the case where the cut paper is printed, the printing apparatus in the present embodiment can handle print operations for roll paper. In the case of roll paper, since all print operations can be performed in the state in which the print medium is nipped by the conveyance roller pair 31 irrespective of the rear end blank amount M2, all of the conveyance operations are the "normal conveyance." Upon the completion of the print operation of the last line, the print medium is conveyed by a distance corresponding to the rear end blank amount M2, and then, the rear end of a page is cut by the cutter 8, and finally, the print medium is discharged.

Second Embodiment

Figure 10:
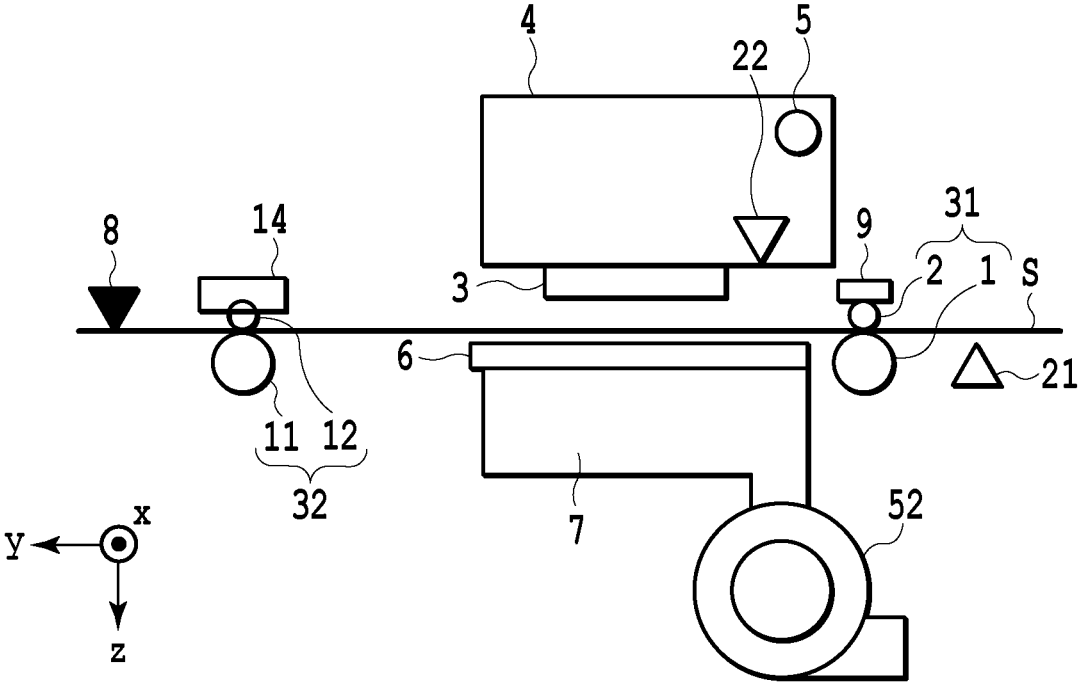
FIG. 10 is a cross-sectional view showing a print unit of a printing apparatus.

FIG. 10 is a cross-sectional view showing a print unit of an ink jet printing apparatus 100 for use in the present embodiment. Although this ink jet printing apparatus 100 basically has the same configuration as that of the printing apparatus explained in the first embodiment, it is different from that in the first embodiment in that a discharge roller pair 32 including a discharge roller 11 and a spur 12 is disposed downstream (i.e., in a +y direction) of a platen 6.

Like a conveyance roller 1, the discharge roller 11 is a drive roller connected to a conveyance motor 51 (FIG. 4). The plurality of spurs 12 are arranged in an x direction while being fixed to a spur holder 14 that can ascend and descend in ±z directions. In a case where the spurs 12 descend in the z direction, a nipped portion is formed between the discharge roller 11 and the same, as shown in FIG. 10, the spurs can rotate by following the rotation of the discharge roller 11. A separation mechanism 13 in the present embodiment can individually control the ascent and descent of a pinch roller holder 9, that is, the switch of nipping (holding) and not nipping (not holding) a conveyance roller pair 31 and the ascent and descent of the spur holder 14, that is, the switch of nipping and not nipping the discharge roller pair 32.

In the present embodiment, whether or not a print medium S is nipped by the discharge roller pair 32 depends on a type of print medium. More specifically, in the case of a print medium having a sensitive surface (a first side) or a print medium impervious to ink, the contact of the pulley 12 may degrade an image, and therefore, the discharge roller pair 32 is released from nipping. In other words, like the first embodiment, the print medium S is conveyed by only the conveyance roller pair 31.

Figure 11A:
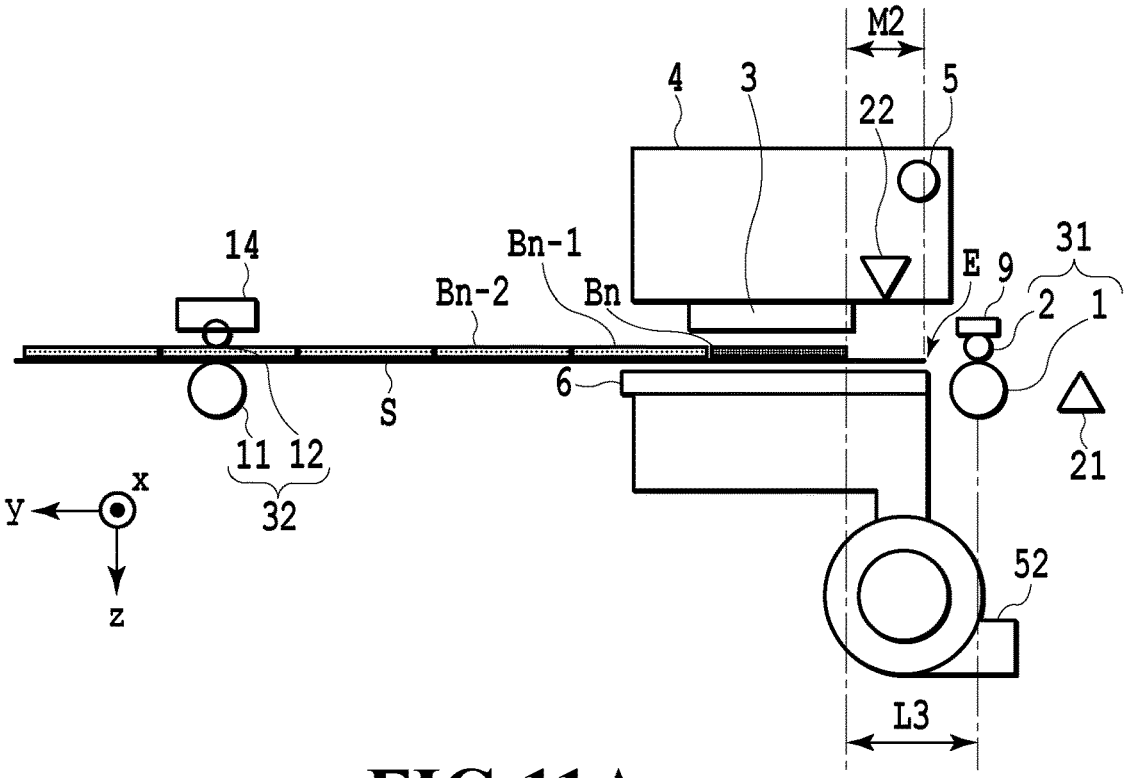
FIGS. 11A and 11B are diagrams illustrating a case where a discharge roller pair is used and a case where the discharge roller pair is not used, respectively.
Figure 11B:
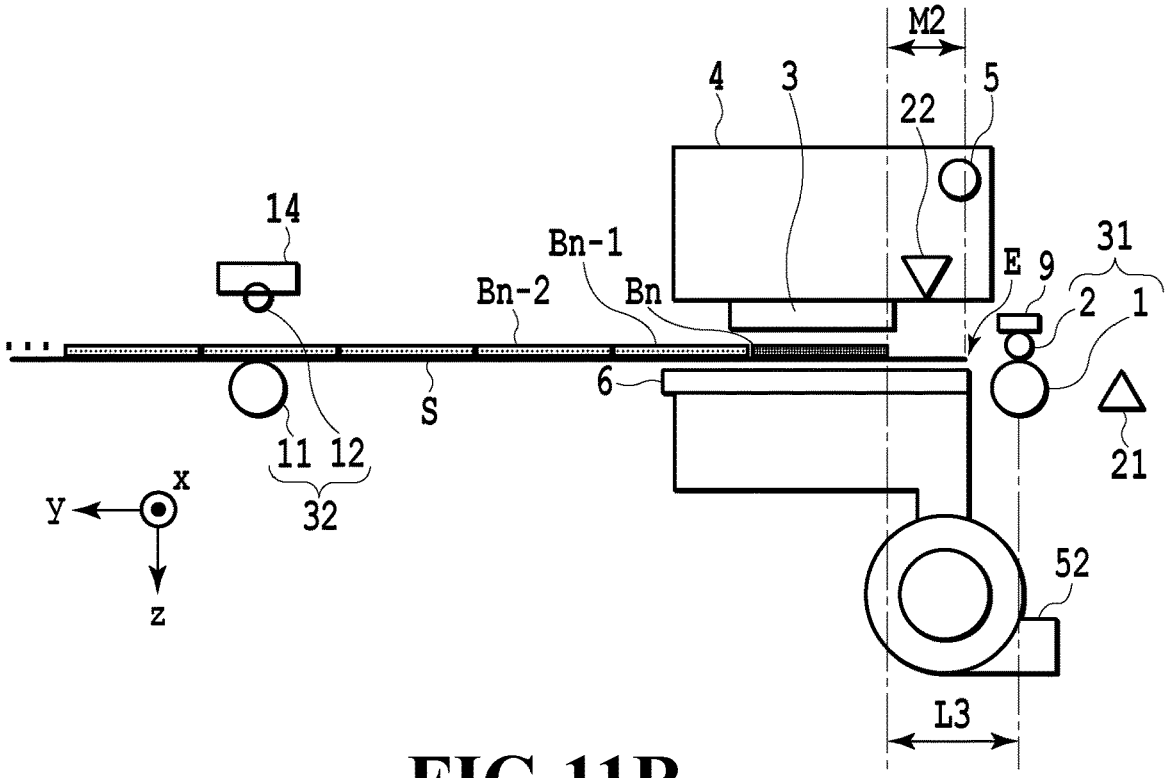

FIGS. 11A and 11B illustrate a case where print operations are performed by using the discharge roller pair 32 and a case where they are performed by not using it, respectively. In either case, a last (n-th) print operation is performed while a rear end blank amount M2 (<L3) remains on the print medium S. Since M2<L3, a rear end E of the print medium S leaves the conveyance roller pair 31 by a previous conveyance operation.

Here, when the discharge roller pair 32 remains in the nipped state illustrated in FIG. 11A, the print medium S can be conveyed by the discharge roller pair 32. As a consequence, a conveyance operation immediately before the last (n-th) print operation also is "normal conveyance," during which a discharge roller is rotated by an amount equivalent to a last band Bn.

In contrast, in a case where the discharge roller pair 32 remains in the non-nipped state illustrated in FIG. 11B, no roller pair supports the print medium S during the conveyance operation immediately before the last (n-th) print operation. Thus, this conveyance operation is "release conveyance," like the first embodiment.

Figure 12:
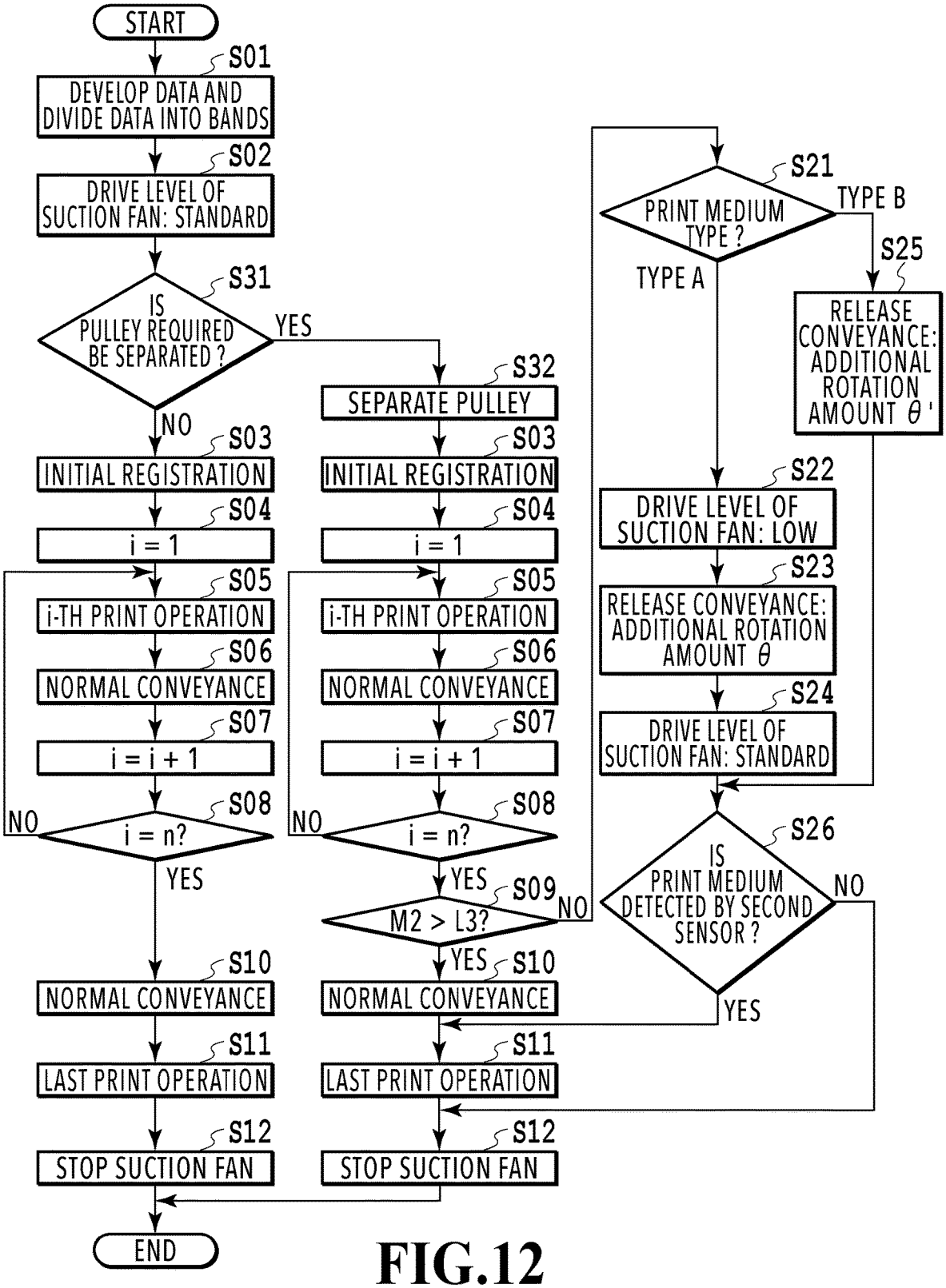
FIG. 12 is another flowchart illustrating a printing process.

FIG. 12 is a flowchart illustrating a printing process to be performed by a CPU 404 installed in the printing apparatus in the present embodiment. The discharge roller pair 32 remains in the nipped state by default in the present embodiment. The same step numbers in this flowchart designate the same processing illustrated in FIG. 9, and therefore, their explanation will be omitted below.

In step S02, upon the start of the drive of a suction fan 52 on a standard level, the CPU 404 proceeds to step S31, and determines whether or not the spurs 12 are required to be separated based on information on the print medium, set in accordance with print data, or the like. As for a print medium having little influence on the quality of an image in spite of the contact of the spurs with the surface of an image, it is determined that the spurs 12 are not required to be separated, and then, the CPU 404 proceeds to step S03, and carrys out the initial registration. At this time, the discharge roller pair 32 makes separation, contact, and rotation in association with the conveyance roller pair 31. Thereafter, the CPU 404 performs a series of processing up to a print operation of a last line in step S11 in a state in which the pulley 12 remains in contact with the print medium. In step S12, the CPU 404 stop the suction fan 52, and thus, this processing comes to an end.

In contrast, in step S31, as for print mediums possibly having an influence on the quality of an image caused by the contact of the spurs with the surface of an image, the CPU 404 determines that the spurs 12 are required to be separated, proceeds to step S32 and separates the spurs 12 from the discharge roller 11 so as to release the nipped state of the discharge roller pair 32. A series of processing in step S03 onwards is the same as that illustrated in the first embodiment.

In the above-described present embodiment, in a case where an image is hardly degraded by the contact of the spurs 12 even in the case of an image having a smaller rear end blank amount M2 than a length L3, all conveyance operations are "normal conveyance," in which the print operations are performed while the print medium is supported by the discharge roller pair 32.

In contrast, in a case where an image may be degraded by the contact of the spurs 12, the print medium is released from the state nipped by the discharge roller pair 32. Additionally, in a case where the rear end blank amount M2 is smaller than the length L3, "release conveyance" in which at least one of driving the suction fan 52 and a rotating amount of the conveyance roller 1 is different from that during the "normal conveyance" is performed only during a last conveyance operation. As a consequence, an image of a good quality can be printed up to the vicinity of the rear end of the print medium irrespective of the type of print medium or conditions.

Although the additional rotation amount θ of the conveyance roller 1 in step S23 and the additional rotation amount θ' of the conveyance roller 1 in step S25 are different from each other in the flowcharts illustrated with reference to FIG. 9 and FIG. 12, they may be equal to each other (θ=θ').

Moreover, although the types of print mediums are classified into the type A and the type B in the above-described embodiment, followed by the proper "release conveyance," respectively, the present invention is not limited to this. The types of print mediums may be single or plural. Furthermore, since the inertial force during the "release conveyance" is influenced by the size of the print medium, a type may be varied according to not only its type (kind) but also its size. At this time, only the drive level of the suction fan 52 may be different from that during the "normal conveyance" in the state in which the additional rotation amount θ is zero, that is, the rotation amount of the conveyance roller 1 is identical to that during the "normal conveyance." At any rate, as long as the rotation amount of the conveyance roller 1 and the drive force of the suction fan during the release conveyance are proper during each of the "normal conveyance" and the "release conveyance," the effects of the present invention can be produced.

In addition, in step S01, the CPU 404 may divide the image into n equal pieces of band data based on the size of the image to be printed in the y direction so as to uniformly achieve all print scanning. Moreover, the bandwidth or conveyance amount may be individually set according to print operations of lines or conveyance operations. Furthermore, although the description has been given above of one-pass printing in which one and the same image area of the print medium is completed by one print operation, the present invention is applicable to multi-pass printing in which one and the same image area is completed by print scanning a plurality of times. At any rate, in a case where the print operation of the last band is performed in the non-nipped state by the conveyance roller pair 31, the "release conveyance" featured by the present invention can be effectively used.

Although, as illustrated in FIG. 4, the description has been given above of the mode in which the image data formed in the host apparatus 300 is input into the printing apparatus 100 through the printer driver 301, the present invention is not limited to this. A digital camera or a mobile terminal may be connected in place of the host apparatus 300. Alternatively, the printing apparatus may directly read image data stored in a memory card. In this case, a user may input a blank amount including a fore end blank amount M1 or a rear end blank amount M2 of cut paper via a operation panel 103.

Additionally, although the suction fan has been used as a unit for sucking the print medium to the platen 6 in the above-described embodiments, the present invention is not limited to this. A holding force producing unit for producing a function of holding a print medium on a platen may simply adopt other configurations such as an electrostatic producing unit.

Furthermore, although the conveyance distance has been adjusted based on the additional rotation amount θ of the conveyance roller 1 during the "release conveyance" in the above-described embodiments, a rotational speed of the conveyance roller 1 may also be varied at the same time. For example, if the rotational speed during the "release conveyance" is higher than that during the "normal conveyance," the movement of the print medium in the y direction can be promoted. Moreover, while the additional rotation amount θ remains fixed, only the rotational speed is varied, so as to adjust an inertial force or a conveyance distance. At any rate, at least one of the conveyance roller 1 and the suction fan 52 is driven in a different manner during the "normal conveyance" or the "release conveyance," thus properly controlling the conveyance amount of the print medium S in both cases.

In addition, although the description has been given above of the print head 3 of the ink jet system, the present invention is not limited to this mode. With a printing apparatus of a serial type in which a print operation by a predetermined band width and a conveyance operation for conveying a print medium in a y direction by a distance corresponding to the band width are alternately repeated, a print system of a print head is not particularly restricted.

The present invention can also be implemented in processing for supplying a program fulfilling one or more functions in the above-described embodiments to a system or an apparatus over a network or via a storage medium, and then, for reading and executing the program by one or more processors in a computer installed in the system or the apparatus. Additionally, the present invention can be implemented by a circuit (such as an ASIC) fulfilling one or more functions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-014625 filed Jan. 31, 2018, which is hereby incorporated by reference wherein in its entirety.

What is claimed is:

1. A printing apparatus comprising:

a carriage configured to move a print head having nozzles arranged in a first direction, in a second direction crossing the first direction;

a conveying unit disposed upstream of the print head in the first direction and configured to convey a print medium in the first direction according to a rotation of a conveyance roller and a driven roller which hold the print medium therebetween;

a platen located at a position facing the print head and configured to support the print medium;

a producing unit configured to produce a holding force for holding the print medium at the platen; and a control unit configured to control the conveying unit in order to convey the print medium, wherein the printing apparatus performs a print operation in which the print head prints an image during the carriage is moved and a conveyance operation in which the conveying unit conveys the print medium by a predetermined distance, so as to print an image on the print medium, the conveyance operation including:

a first conveyance operation in which the print medium held between the conveyance roller and the driven roller is conveyed without any release from between the conveyance roller and the driven roller on the way of the rotation of the conveyance roller; and a second conveyance operation in which the print medium held between the conveyance roller and the driven roller is released from between the conveyance roller and the driven roller on the way of the rotation of the conveyance roller, and then, is conveyed, wherein, after the second conveyance operation, the print medium is held on the platen by the holding force and thus, an image is printed of a predetermined length in the first direction, and wherein the control unit controls the conveying unit in such a manner as to increase the rotation amount of the conveyance roller during the second conveyance operation than the rotation amount of the conveyance roller during the first conveyance operation in a case where an image is printed by the predetermined length in the first direction after the first conveyance operation.

2. The printing apparatus according to claim 1, wherein a conveying unit for holding and conveying the print medium is not provided downstream of the print head.

3. The printing apparatus according to claim 1, wherein the control unit further controls the producing unit such that the holding force during the second conveyance operation is smaller than the holding force during the first conveyance operation.

4. The printing apparatus according to claim 1, wherein the control unit controls the conveying unit and the producing unit such that a rear end of the print medium is located at a constant position during the second conveyance operation.

5. The printing apparatus according to claim 1, wherein the control unit controls the conveying unit and the producing unit such that the holding force during the second conveyance operation is varied according to a type or size of print medium.

6. The printing apparatus according to claim 1, wherein the control unit controls the producing unit based on information on a weight of the print medium such that the holding force during the second conveyance operation in a case where the print medium is a first print medium is smaller than the holding force in a case where the print medium is a second print medium which is heavier than the first print medium.

7. The printing apparatus according to claim 1, wherein the control unit compares a distance from a most upstream position in a print width of the print head in the first direction to a portion held between the conveyance roller and the driven roller with a blank amount formed at a rear end of an image on the print medium so as to determine whether or not to perform the second conveyance operation.

8. The printing apparatus according to claim 1, wherein the producing unit increases the holding force during the print operation after the second conveyance operation more than the holding force during the print operation before the second conveyance operation.

9. The printing apparatus according to claim 1, further comprising:

a determining unit configured to determine whether or not the print medium exists on the platen, wherein in a case where the determining unit determines that no print medium exists, no print operation is performed irrespective of the existence of image data to be printed on the print medium.

10. The printing apparatus according to claim 1, further comprising:

a discharging unit disposed downstream of the print head in the first direction and configured to convey the print medium in the first direction after an image is printed by the print head according to the rotation of a discharge roller and a driven roller while holding the print medium therebetween so as to discharge the print medium; and a switching unit configured to switch a held state and a non-held state between the discharge roller and the driven roller, wherein the control unit controls the conveying unit and the producing unit such that the rotation amount of the conveyance roller and the holding force during the second conveyance operation are equal to those during the first conveyance operation in a case where the switching unit puts the discharge roller and the driven roller in the held state, whereas the control unit controls the conveying unit and the producing unit such that at least one of the rotation amount of the conveyance roller and the holding force during the second conveyance operation is different from those during the first conveyance operation in a case where the switching unit puts the discharge roller and the driven roller in the non-held state.

11. The printing apparatus according to claim 1, wherein the producing unit produces a suction force at the platen by the use of a suction fan.

12. The printing apparatus according to claim 1, wherein the print head is of an ink jet system configured to eject ink droplets in accordance with image data.

13. The printing apparatus according to claim 1, wherein the control unit controls the conveying unit such that a rotational speed of the conveyance roller during the second conveyance operation is higher than that of the conveyance roller during the first conveyance operation.

14. The printing apparatus according to claim 1, wherein the producing unit stops the production of the holding force upon the completion of the print operation of a last band on the print medium by the print head so as to discharge the print medium by its own weight.

15. A printing apparatus comprising:

a print head having nozzles arranged therein;

a conveying unit disposed upstream of the print head in a first direction and configured to convey a print medium in the first direction according to a rotation of a conveyance roller and a driven roller which hold the print medium therebetween;

a platen located at a position facing the print head and configured to support the print medium;

a producing unit configured to produce a holding force, for holding the print medium, at the platen; and a control unit configured to control the conveying unit in order to convey the print medium, wherein the printing apparatus performs a print operation in which the print head prints an image and a conveyance operation in which the conveying unit conveys the print medium by a predetermined distance, so as to print an image on the print medium, the conveyance operation including:

a first conveyance operation in which the print medium held between the conveyance roller and the driven roller is conveyed without any release from between the conveyance roller and the driven roller on the way of the rotation of the conveyance roller; and a second conveyance operation in which the print medium held between the conveyance roller and the driven roller is released from between the conveyance roller and the driven roller on the way of the rotation of the conveyance roller, and then, is conveyed, wherein, after the second conveyance operation, the print medium is held on the platen by the holding force and thus, an image is printed of a predetermined length in the first direction, and wherein the control unit controls the conveying unit in such a manner as to increase the rotation amount of the conveyance roller during the second conveyance operation than the rotation amount of the conveyance roller during the first conveyance operation in a case where an image is printed by the predetermined length in thefirst direction after the first conveyance operation.

16. The printing apparatus according to claim 15, wherein the control unit further controls the producing unit such that the holding force during the second conveyance operation is smaller than the holding force during the first conveyance operation.

17. A control method of a printing apparatus, the printing apparatus including:

a carriage configured to move a print head having nozzles arranged in a first direction, in a second direction crossing a first direction;

a conveying unit disposed upstream of the print head in the first direction and configured to convey a print medium in the first direction according to a rotation of a conveyance roller and a driven roller which hold the print medium therebetween;

a platen located at a position facing the print head and configured to support the print medium; and a producing unit configured to produce a holding force, for holding the print medium, at the platen, the control method comprising the steps of:

performing a print operation in which the print head prints an image during the carriage is moved and a conveyance operation in which the conveying unit conveys the print medium by a predetermined distance, so as to print an image on the print medium; and controlling the conveying unit in a case where the print medium is conveyed, wherein the conveyance operation includes:

a first conveyance operation in which the print medium held between the conveyance roller and the driven roller is conveyed without any release from between the conveyance roller and the driven roller on the way of the rotation of the conveyance roller; and a second conveyance operation in which the print medium held between the conveyance roller and the driven roller is released from between the conveyance roller and the driven roller on the way of the rotation of the conveyance roller, and then, is conveyed, wherein, after the second conveyance operation, the print medium is held on the platen by the holding force and thus, an image is printed of a predetermined length in the first direction, and wherein in the controlling step, the conveying unit is controlled in such a manner as to increase the rotation amount of the conveyance roller during the second conveyance operation than the rotation amount of the conveyance roller during the first conveyance operation in a case where an image is printed by the predetermined length in the first direction after the first conveyance operation.

* * * * *